US006250594B1

(12) United States Patent
Niehaus

(10) Patent No.: US 6,250,594 B1
(45) Date of Patent: Jun. 26, 2001

(54) DEVICE FOR HEIGHT ADJUSTMENT OF PANELS

(76) Inventor: Joachim Niehaus, Bahnhofstrasse 3, D-59469 Ense (DE)

( * ) Notice: Subject to any disclaimer, the term of this patent is extended or adjusted under 35 U.S.C. 154(b) by 0 days.

(21) Appl. No.: 09/367,818

(22) PCT Filed: Dec. 17, 1998

(86) PCT No.: PCT/DE98/03711

§ 371 Date: Aug. 23, 1999

§ 102(e) Date: Aug. 23, 1999

(87) PCT Pub. No.: WO99/32012

PCT Pub. Date: Jul. 1, 1999

(30) Foreign Application Priority Data

Dec. 22, 1997 (DE) ..... 197 57 313

(51) Int. Cl.[7] ..... A47F 5/12

(52) U.S. Cl. ..... 248/188.2; 248/396; 108/8; 108/147.12; 108/147.19

(58) Field of Search ..... 248/188.1, 188.2, 248/371, 396, 398, 188.4, 188.5, 393, 394; 108/4, 7, 8, 144.11, 147, 147.12, 147.19

(56) References Cited

U.S. PATENT DOCUMENTS 862,943 * 8/1907 Swart ..... 108/4
4,257,569 * 3/1981 Budinski ..... 248/396
5,224,429 * 7/1993 Borgman et al. ..... 108/147.12
5,483,903 * 1/1996 Pierce et al. ..... 108/147.12
5,528,782 * 6/1996 Pfeuffer et al. ..... 248/396
5,601,037 * 2/1997 Meyer et al. ..... 108/147.11
5,845,590 * 12/1998 Seidl ..... 108/144.11
5,894,344 * 4/1999 Tamez et al. ..... 356/4.08

FOREIGN PATENT DOCUMENTS 38 35 436 4/1990 (DE) .
92 14 214 1/1993 (DE) .
42 27 844 2/1994 (DE) .

* cited by examiner

*Primary Examiner*—Ramon O. Ramirez
*Assistant Examiner*—Jon Szumny
(74) *Attorney, Agent, or Firm*—Venable; Gabor J. Kelemen; Catherine M. Voorhees

(57) ABSTRACT

A device to adjust the height of panels, more particularly, the height of working tables includes at least one console (12) which is mounted to a stand and fitted with at least two vertical translational lifting elements (14). A lid or cover (13) is screwed on the console (12). An opening is formed between the console (12) and the lid or cover (13) which is adapted to receive a profile section of a frame. The profile section is clamped between the lid and the console when the lid is screwed to the console. The lifting elements (14) are located in holes (121) in the console (12). The lifting elements (14) are inserted in the holes (121) in such a way that they can not rotate.

14 Claims, 7 Drawing Sheets

DEVICE FOR HEIGHT ADJUSTMENT OF PANELS

BACKGROUND OF THE INVENTION

The invention relates to a device for adjusting the height of panels, particularly work tables, having at least one console that is mounted to a stand or table-framework and is provided with at least two vertical translational lifting elements.

Devices of this type are known as height adjusters of tables, especially work tables, conference tables or drawing tables, etc. The known height adjusters (see DE 297 06 520 U1) directly engage the work table to be adjusted. Two height-adjustment devices are secured beneath the panel such that the panel can be displaced in the vertical axis. The known devices are usually equipped with a housing, in which the lifting elements are accommodated. The housing is screwed to the table stand or framework. For this purpose, special fastening means are mounted to the stand and the housing.

A disadvantage of known devices is that they can only be disposed at locations defined by receptacles that are provided on the stands or framework. Furthermore, known devices are complicated to produce because of special receptacles on the housings and stands or framework.

SUMMARY OF THE INVENTION

It is the object of the invention to provide a device for adjusting the height of panels, the device having a simple design and being secured to arbitrary points on the stands or table-framework. In accordance with the invention, this object is accomplished by a height adjusting device mounted on the stand where a lid is screwed to the console of the device; an opening is embodied between the console and the lid; the lifting elements are received by bores in the console; and the lifting elements are inserted, fixed against relative rotation, into the bores.

With the embodiment of the invention, it is possible to dispose the device at arbitrary points on the stands or table-framework. The mounting of the device to the stand or framework occurs in that a profile section of the frame extends through the opening between the lid and the console. The opening matched the profile of the frame. After the lid has been screwed to the console, the device is clamped to the profile. The bores offer a simple means of securing the lifting elements in the console. This also facilitates assembly considerably.

In one embodiment of the invention, at least one boss, which is guided in slots of the console, is embodied on the lifting elements. This is a simple means of assuring a high operating reliability of the device of the invention.

In a modification of the invention, the lifting elements are supported on rings having a central hole. This assures a simple device assembly. This modification also assures reliable functioning of the lifting elements.

In a modification of the invention, a recess is provided in the console, between the lifting elements. The recess or opening is adapted in cross-section to the cross-section of the framework. The varying size of the recess permits framework profiles of larger dimensions to be guided through between the console and the lid.

In an advantageous embodiment of the invention, each lifting element has a support element that is embodied in the form of an axle and is received by a receptacle in the lifting element. The support elements engage a rectangular tubular frame on which a workable or tabletop secured. provision of support elements assures the function of the height adjuster at the panel, even under difficult installation conditions. The axle form is especially well-suited because of its stability properties. Moreover, it can be produced economically.

In an advantageous modification of the invention, the axles are guided in a hole or a slot by their ends remote from the lifting element. The use of holes and slots permits the compensation of the occurring path elongation with a desired inclination of the panel.

The lifting elements are preferably provided with a ruler, which makes it simple to ascertain the respective height of the lifting element.

The dependent claims disclose modifications and embodiments of the invention. The drawing illustrates an embodiment of the invention, which is described in detail

DETAILED DESCRIPTION OF THE INVENTION

Figure 1:
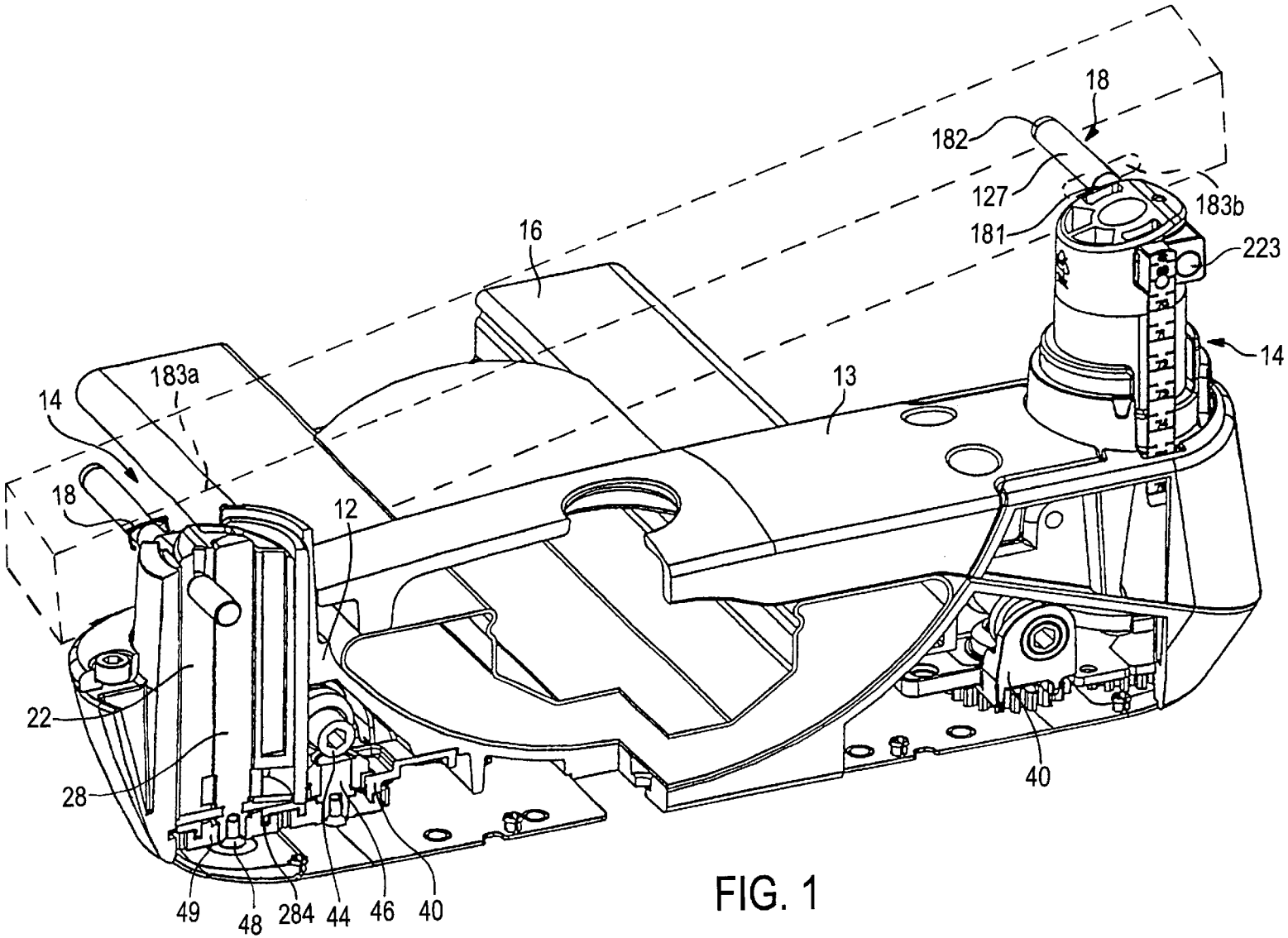
FIG. 1 is a device for height adjustment.
Figure 7:
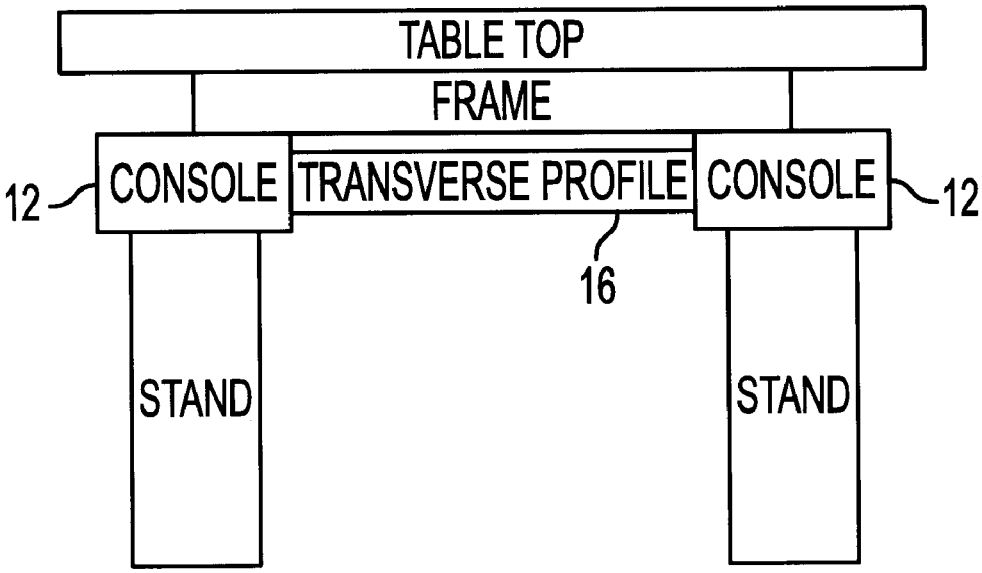
FIG. 7 is a schematic diagram of a table according to the invention.

The device selected as the illustrated embodiment comprises two consoles 12, which are secured, with spacing from one another, to a traverse profile of a table frame. One of the consoles 12 is secured to the right, while the other is secured to the left, beneath a tabletop. The consoles 12 are secured to a frame profile through the screwing of a lid 13 to the console 12. The traverse profile 16 extends through an opening embodied between the console 12 and the lid 13. The device is thereby clamped to the traverse profile 16. As shown in phantom on FIG. 1 a rectangular tubular frame, for example, can be used to secure the device to a work table. FIG. 7 is a schematic representation of such a table. The console 12 and the lid 13 are embodied as aluminum/magnesium diecast parts.

The two consoles are connected by a synchronous drive shaft in the form of a hexagonal shaft. The consoles permit the simultaneous adjustment of the height and inclination of the table to which they are secured. A plurality of tabletops can be linked with the height drive of the consoles. The synchronous drive shafts are guided via a connecting gear by means of an operator hand crank, which permits a simple adjustment to the height and inclination of the connected shafts and lifting elements 14.

Bores 121 are provided in the console 12. These bores 121 receive the lifting elements 14. A recess 123 is embodied in the console, between the bores 121. The lid 13 has two openings 131 for the passage of the lifting elements 14. In the illustrated embodiment, the lid 13 is shown in two pieces. The two lifting elements 14 are inserted, fixed against relative rotation, into the console 12.

The lifting elements 14 respectively comprise a piston 22, a sleeve 20, a hexagonal nut 26 provided with an inside thread and a spindle 28, which is provided with an outside thread that engages the inside thread of the nut. The piston 22 has at its lower end an insertion compartment 221 for the nut 26. The piston 22 is provided with a central bore 222. Consequently, only the nut 26 need be provided with an inside thread; no inside thread need be provided in the central bore 222. This simplifies the production of the lifting elements 14.

In the illustrated embodiment, the height adjuster has a gear 30 with a gear receptacle 40 and the spindle 28.

In the illustrated embodiment, the lifting element 14 is provided with a ruler 23, which indicates the adjustment path to the user. This is particularly practical if the individual lifting elements 14 can be adjusted independently of one another. Thus, it is possible to adapt the height adjusters of the individual lifting elements 14 to the respective other adjusters to permit a parallel displacement of the panel.

In the region of its upper edge, the ruler 23 has a reading marker 231. A recess 125 is provided in the bordering cover for the console 124. The ruler 23 passes through the recess 125. A sliding slot 126 for the ruler 23 is provided in the extension of the recess 125. The ruler 23 is symmetrical for the purpose of easy replacement. A panel-frame support axle 127 is disposed transversely to the ruler 23.

Figure 2:
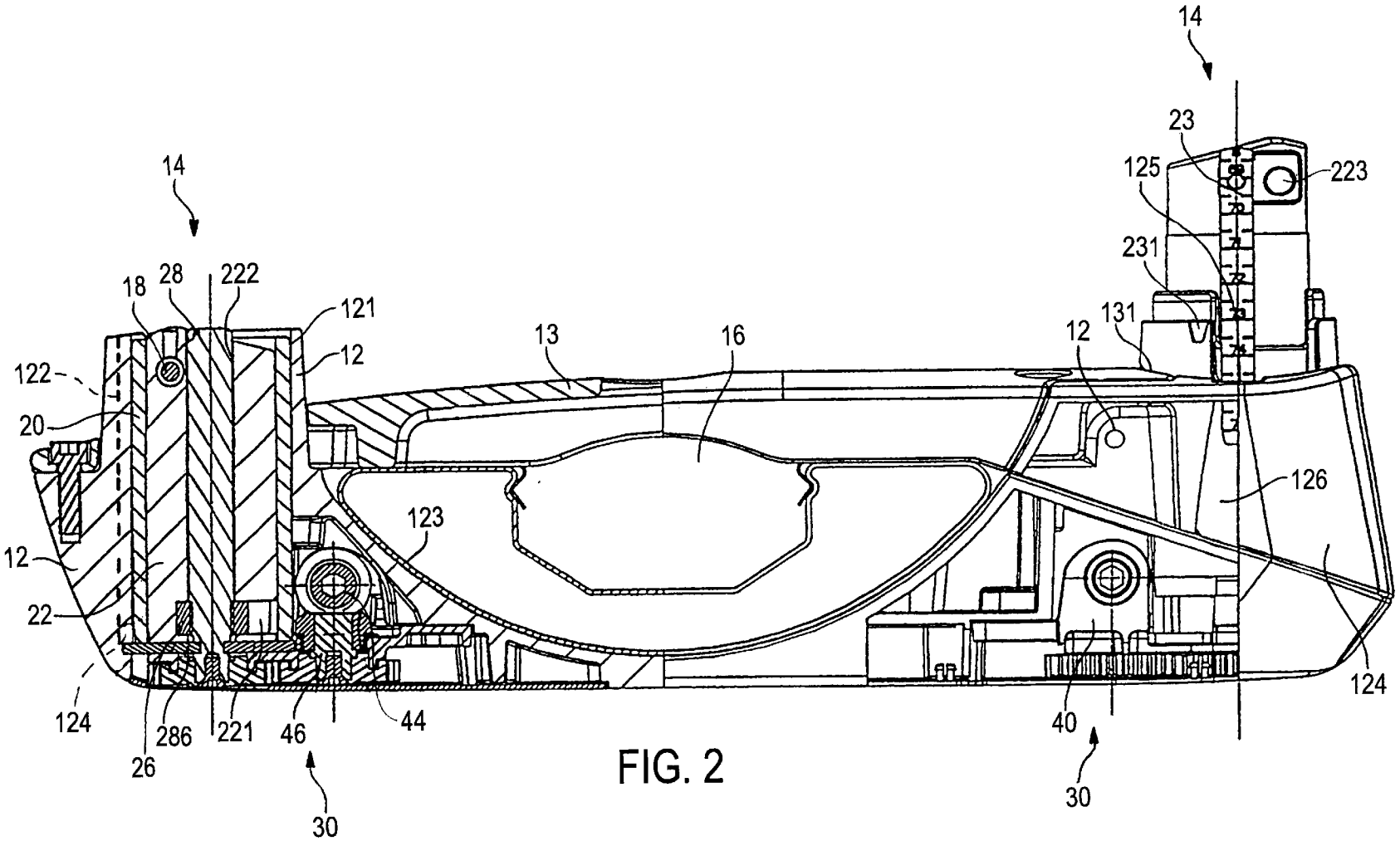
FIG. 2 is a longitudinal section through the device shown in FIG. 1.
Figure 3:
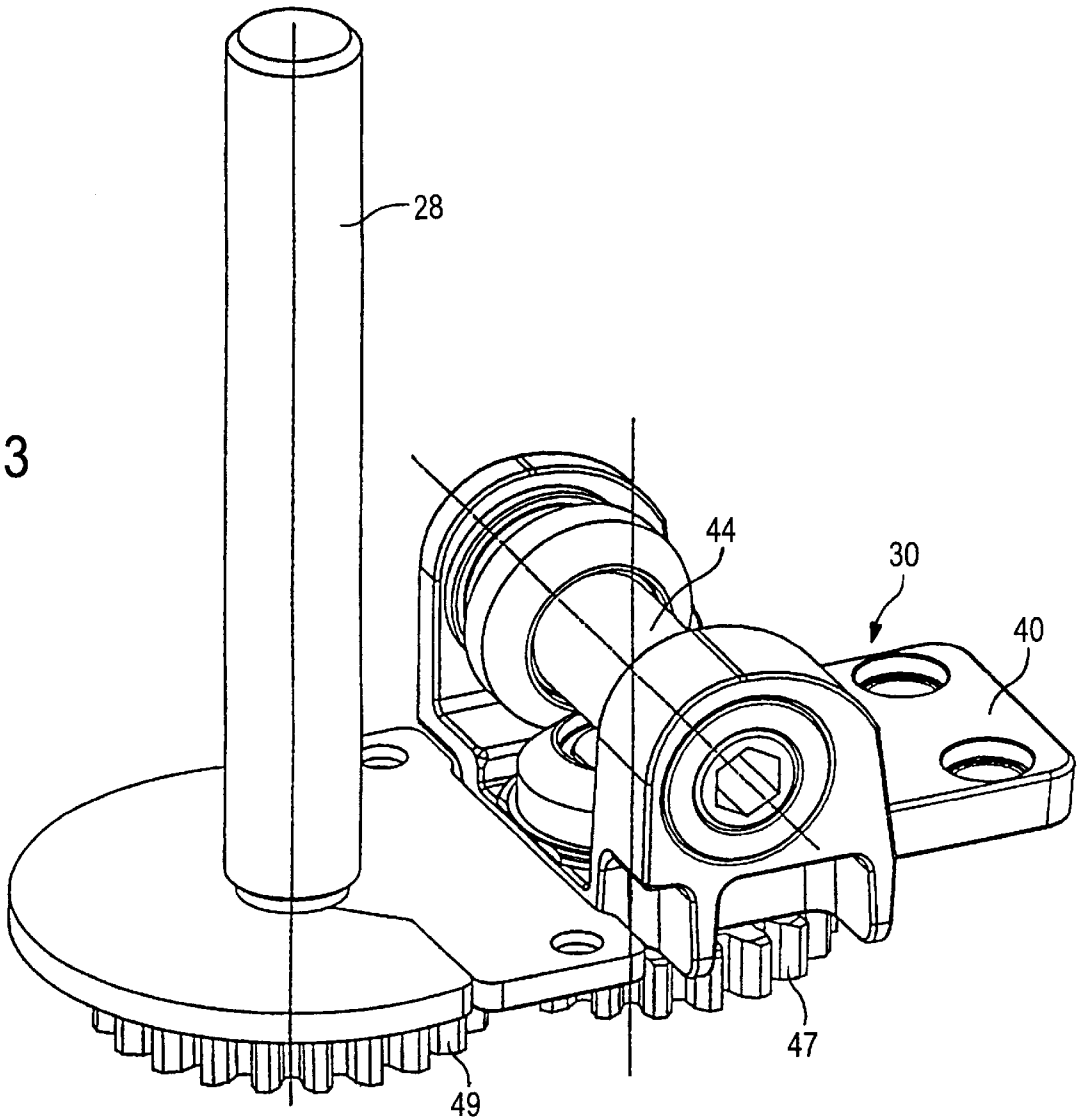
FIG. 3 is a gear having a drive spindle and a bearing arrangement for the device according to FIG. 1.
Figure 4:
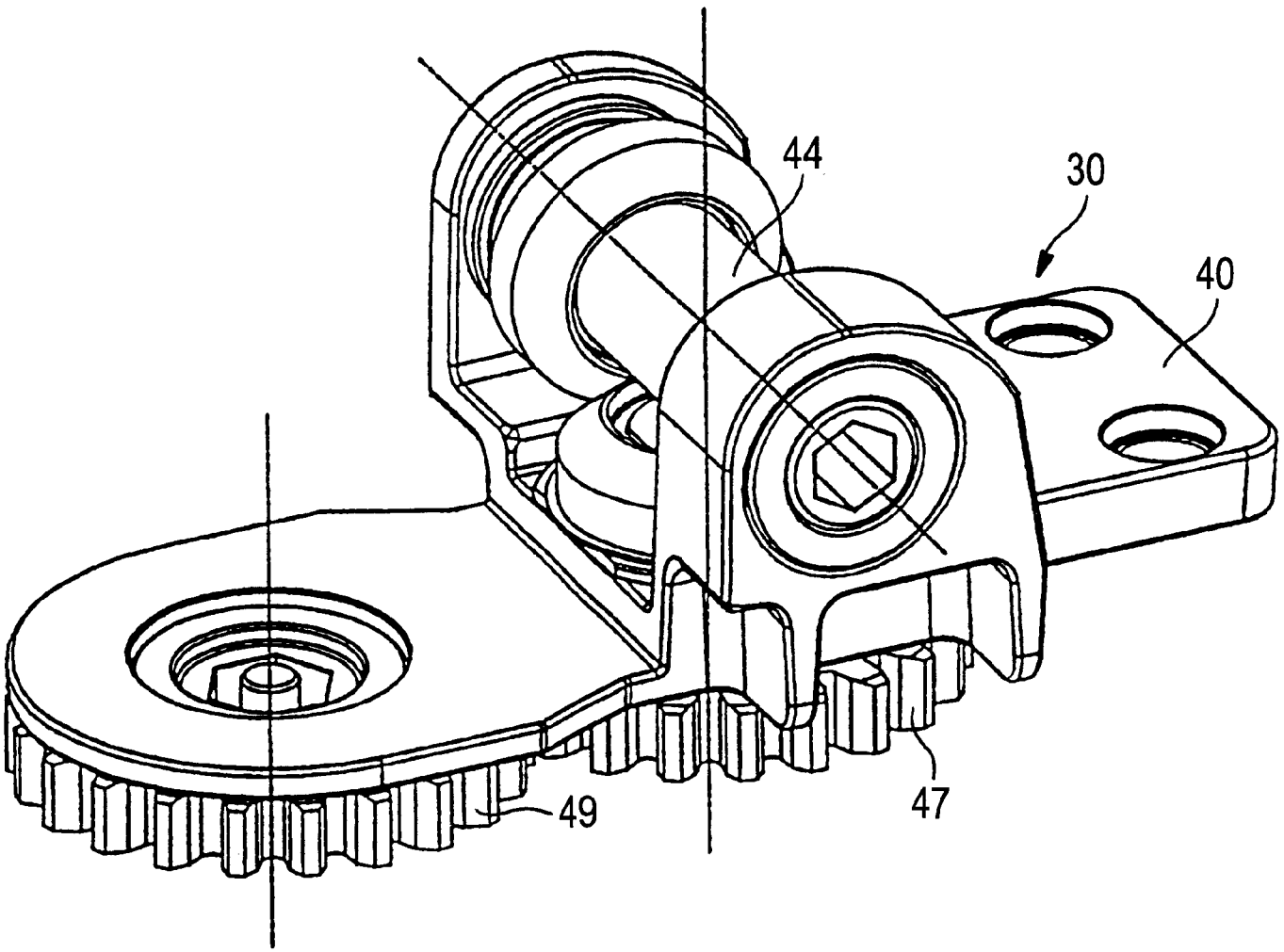
FIG. 4 is the gear according to FIG. 3.
Figure 5:
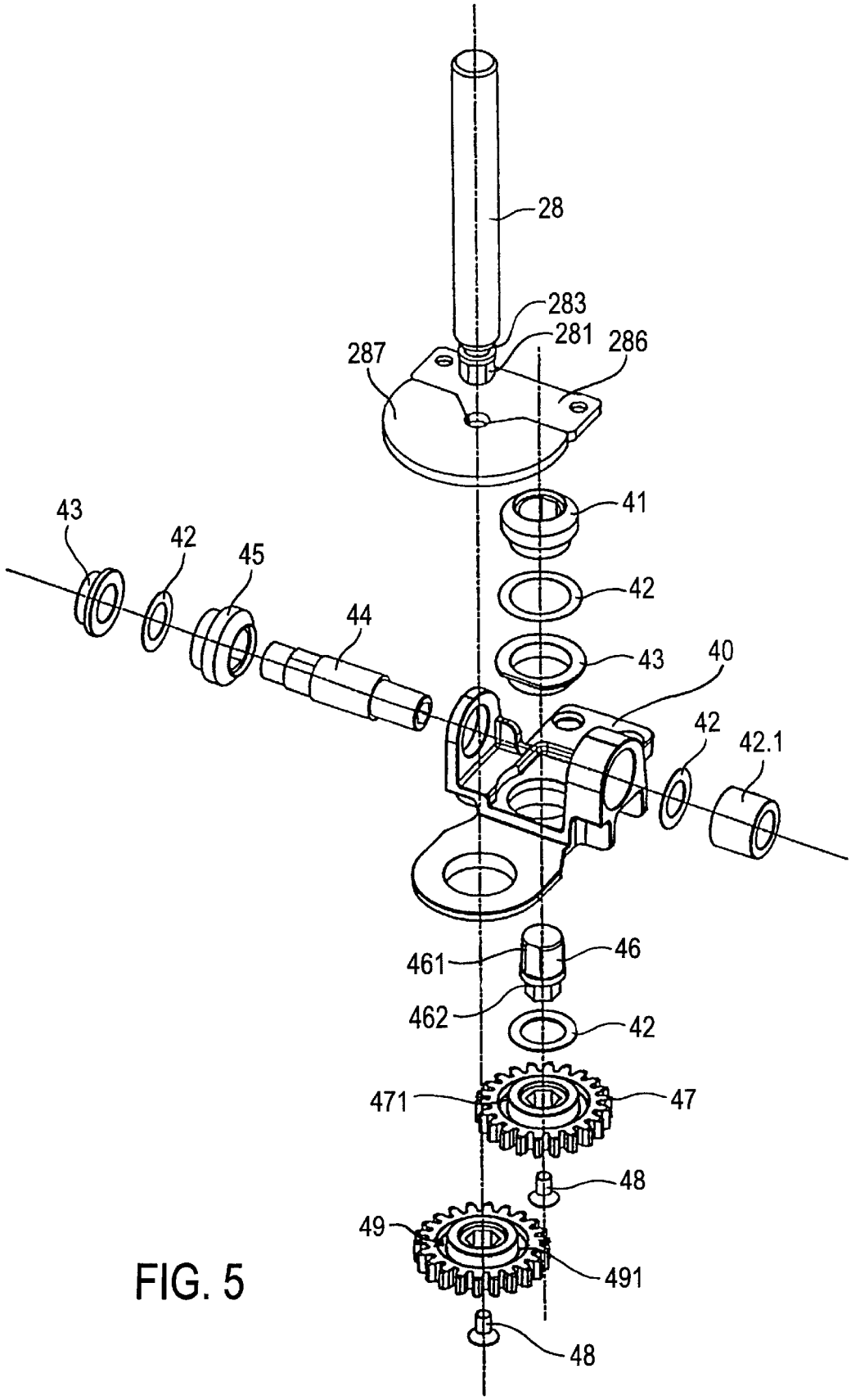
FIG. 5 is the gear with the drive spindle and bearing arrangement according to FIG. 3, in an exploded representation, as seen from above.
Figure 6:
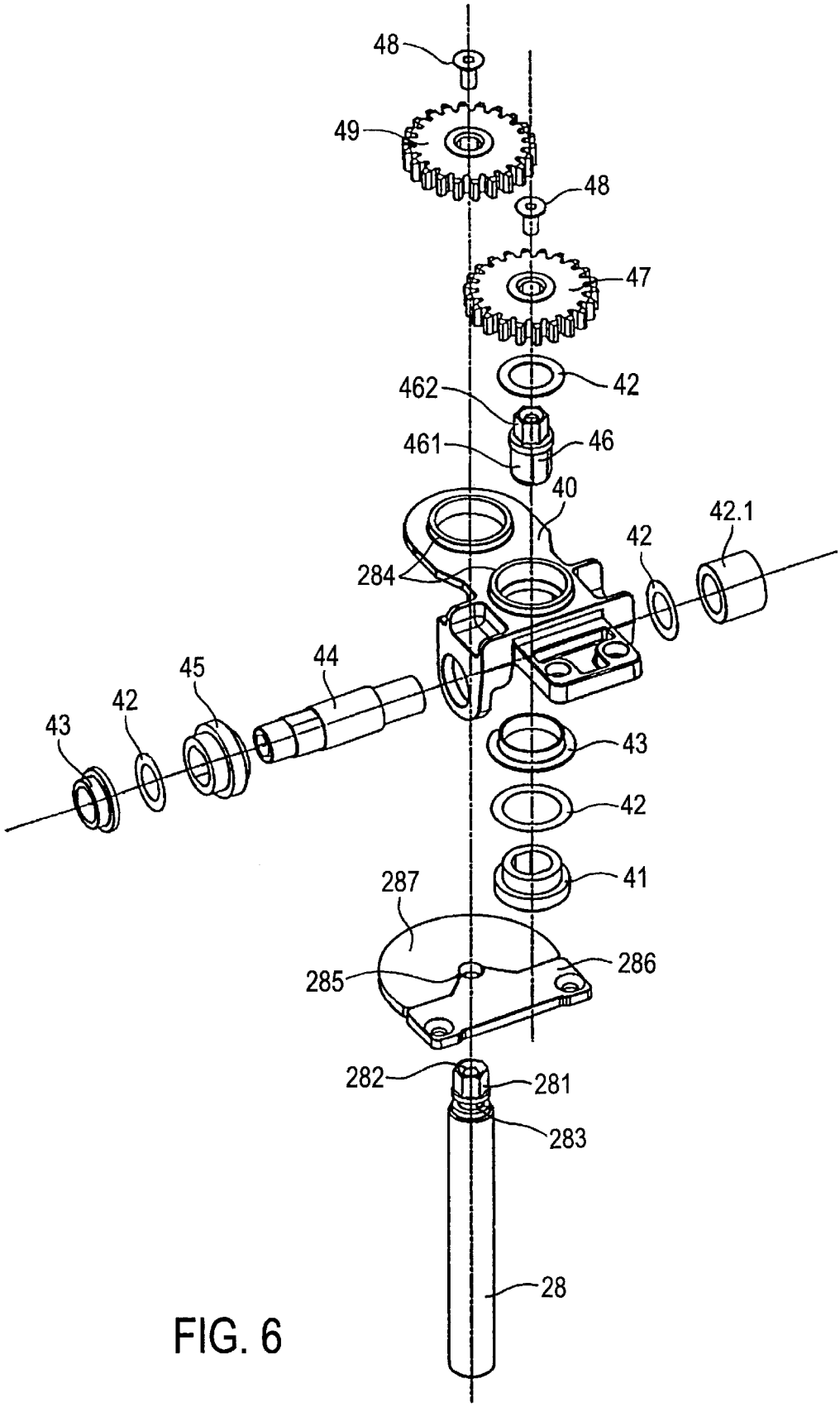
FIG. 6 is the exploded representation of FIG. 5, as seen from below.

Bosses 24 are embodied at the lower end of the console 12 for securing the sleeve 20 against relative rotation in the console. In the assembled state of the device, these bosses are guided in slots 122 of the console 12 (see FIG. 2). The slots 122 cooperate with the bosses 24 to serve as securing means against relative rotation, and as a stop at their end remote from the panel.

A receptacle 223 is provided at the end of the piston 22 remote from the panel. In the assembled state of the device, the receptacle 223 receives a support element 18. In the illustrated embodiment, the support element 18 comprises an axle that is disposed at a right angle to the central bore 222. The axle in this embodiment is produced from V2A steel. In its region remote from the piston 22, the axle has a groove 181, into which a pin—not shown—extends for preventing the axle from falling out and shifting. Furthermore, two annular grooves 182, in which the rectangular tubular frame is held, are provided in the region of the axle remote from the piston 22. For this purpose, a hole 183*a* is provided in the rectangular tubular frame on the side of the frame facing the user of the panel. The hole 183*a* in the rectangular tubular frame on the side remote from the user is oblong.

At its end remote from the panel or table top, the spindle 28 has an outside polygonal segment 281 for actuating the spindle 28. For securing purposes, a central threaded bore 282 is provided inside the spindle 28, specifically in the region of the outside polygonal segment 281. A groove 283, into which the bearing disks 286 and 287 extend as an abutment, adjoins the polygonal segment 281. To this end, the bearing disks 286 and 287 form central hole 285. In the illustrated embodiment, the bearing disks 286 and 287 are embodied in two parts. The bearing disks 286 and 287 are supported in the console 12.

A bevel wheel 41, a washer 42 and a flange sleeve 43 are disposed on the side of the spindle 28 remote from the bearing disks 286 and 287; these elements are supported on the gear receptacle 40. The gear receptacle 40 is likewise provided with a washer 42 and a sleeve 42.1 at a right angle to the parts 41, 42 and 43. A hexagonal hollow shaft 44, a bevel wheel 45 and, again, a washer 42 and a flange sleeve 43 are provided in the axial direction with respect to the aforementioned washer 42 and the associated sleeve 42.1. The hexagonal hollow shaft 44 serves in the synchronous drive of the right and left table consoles.

An adapter shaft 46 having carrier surfaces 461 and a carrier polygonal segment 462 is provided at a right angle to the hexagonal hollow shaft 44—in the axial direction with respect to the vertical bevel wheel 41. The adapter shaft 46 engages a spur gear 47 provided on the gear side. A further washer 42 is provided between the adapter shaft 46 and the spur gear 47. A fastening screw 48 is inserted into the spur gear 47 on the side remote from the adapter shaft. The spur gear 47 meshes with a spur gear 49 provided on the spindle side. This spur gear 49 is secured with a fastening screw 48 to spindle 28. The gear 47 and the spur gear 49 have a bearing groove 471 and 491, respectively which fit into rings 284 on the gear receptacle 40.

The spur gears 47 and 49 are secured with motion play, i.e., the total gear assembly 30 can float, thereby compensating for tolerance errors with the gear receptacle is therefore not screwed tightly into the console but is attached enabling movement. The bearing rings attain a bridge seating that serves to compensate the radial forces.

In an alternative embodiment of the invention, which is not shown in the drawing, the device can be driven via a bevel-wheel gear and a hexagonal shaft that connects the lifting elements 14 such that the respective assembled lifting elements 14 can be driven to rotate together. It is likewise conceivable for a plurality of consoles 12 or lifting elements 14 of adjacent pieces of furniture to be connected to one another via a shaft, so they can be driven jointly.

What is claimed is:

1. A device for adjusting the height of a panel, comprising:

at least one console that is mounted to a stand, said console containing two vertical translational lifting elements;

a lid adapted to be screwed to said console; and an opening formed between said console and said lid, said opening adapted to receive a profile section of a frame; wherein said profile section is clamped between said lid and said console when the lid is screwed to the console, and each vertical translational lifting element is received by a respective bore in said console and is inserted into the respective bore so that it is fixed against relative rotation.

2. The device according to claim 1, wherein the lifting elements comprise at least one boss that is guided in slots of the at least one console.

3. The device according to claim 1, wherein the lifting elements are supported in the at least one console on rings that have a central hole.

4. The device according to one of claim 1, wherein the opening is provided between the lifting elements, and the at least one console has a recess so that the opening can receive frames of different profiles.

5. The device according to claim 1, wherein the lifting elements have a support element, which is embodied in the form of an axle and is received by a receptacle mounted in each lifting element.

6. The device according to claim 5, wherein the support element is disposed at a right angle to the longitudinal center line of the lifting element.

7. The device according to claim 5, wherein each support element in the form of an axle is guided in a hole or slot of a frame at an end of the axle remote from the lifting element the panel to be adjusted being secured to the frame.

8. The device according to claim 1, wherein the lifting elements are provided with a ruler.

9. The device according to claim 1, wherein each of the lifting elements has a drive spindle that is secured to a gear receptacle by way of a two-part bearing disk.

10. The device according to claim 9, wherein the drive spindle is provided with an outside polygonal segment and a threaded bore, which receive a first spur gear disposed on the spindle side, the first spur gear being brought into engagement with a second spur gear disposed on a gear side of the gear receptacle.

11. The device according to claim 9, wherein each lifting element further comprises an adapter shaft that is guided in the gear receptacle, one side of the adapter shaft being embodied as a polygonal carrier segment for receiving the gear-side spur gear and the other side being embodied as a carrier surface for receiving a vertical bevel wheel.

12. The device according to claim 9, wherein each lifting element further comprises a hexagonal hollow shaft guided transversely to the drive spindle by the gear receptacle, the hexagonal hollow shaft being connected via a horizontal bevel wheel and adapted to receive a hexagonal hollow shaft forming a synchronous drive with a hexagonal hollow shaft of a transverse lifting element.

13. A device for adjusting the height of a panel, comprising:

at least one console that is mounted to a stand, said console being formed with two bores and slots;

two vertical translational lifting elements, each being received in a respective bore of said console;

a lid adapted to be screwed to said console; and an opening formed between said console and said lid; whereby each vertical translational lifting element has at least one boss guided in a respective slot of the at least one console when the lifting element is inserted into the respective bore so that it is fixed against relative rotation.

14. A device for adjusting the height of a panel, comprising:

at least one console that is mounted to a stand, said console being formed with two bores;

a vertical translational lifting element being received in a respective bore of said console, each said vertical translational lifting element being inserted into the respective bore so that it is fixed against relative rotation, each vertical translational lifting element having a drive spindle this is secured to a gear receptacle by way of a two-part bearing disk;

a lid adapted to be screwed to said console; and an opening formed between said console and said lid; wherein each drive spindle is provided with an outside polygonal segment and a threaded bore, which receive a first spur gear disposed on the spindle side, said first spur gear being brought into engagement with a second spur gear disposed on a gear side of the gear receptacle.

* * * * *